US006115023A

United States Patent [19]

Uchida

[11] Patent Number: 6,115,023

[45] **Date of Patent: *Sep. 5, 2000**

[54] RADIO SELECTIVE CALLING RECEIVER WITH DISPLAY FUNCTION AND A PICTURE INFORMATION DISPLAYING METHOD

[75] Inventor: Jun Uchida, Shizuoka, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/648,494

[22] Filed: May 15, 1996

[30] Foreign Application Priority Data

May 16, 1995 [JP] Japan ..... 7-116890

[51] Int. Cl.[7] ..... G09G 5/00

[52] U.S. Cl. ..... 345/114; 345/113; 345/435; 379/93.23

[58] Field of Search ..... 345/112, 113, 345/114, 115, 116, 88, 435, 441, 467, 471, 141, 142; 340/825.44; 379/93.23; 434/30

[56] References Cited

U.S. PATENT DOCUMENTS

| | | | |
|---|---|---|---|
| 3,745,671 | 7/1973 | Mortimer | 434/30 |
| 4,181,973 | 1/1980 | Tseng | 345/142 |
| 4,924,299 | 5/1990 | Mizuno et al. | 345/113 |
| 4,975,694 | 12/1990 | McLaughlin et al. | 340/825.44 |
| 5,426,725 | 6/1995 | Kilgore | 345/114 |
| 5,701,258 | 12/1997 | Harris et al. | 340/825.44 |

FOREIGN PATENT DOCUMENTS

| | | |
|---|---|---|
| 64-19837 | 1/1989 | Japan . |
| 3-6134 | 1/1991 | Japan . |

*Primary Examiner*—Kent Chang
*Attorney, Agent, or Firm*—Ostrolenk, Faber, Gerb & Soffen, LLP

[57] ABSTRACT

Color LCD 7 of a radio selective calling receiver with a display function which displays, on the background of rows of letter characters displayed in blue, picture information such as a battery voltage drop mark in red, which is different from the displaying color of the letter characters, in the full area of the display screen.

8 Claims, 4 Drawing Sheets

DISPLAY SCREEN OF COLOR LCD 7

FIG.2

| ICON SYMBOLS | PICTURE INFOMATION | SIGNIFICATION OF PICTURE INFOMATION |
|---|---|---|
| ICON a | | DROP OF BATTERY VOLTAGE |
| ICON b | | SETTING OF CALLING BY SOUND |
| ICON c | | SETTING OF CALLING BY VIBRATOR |
| ICON d | | OUTSIDE RECEIVING AREA |

DISPLAY SCREEN OF COLOR LCD 7

FIG.4 (a) "b"font

PARTIAL FONT OF LOW VOLTAGE MARK

COMPOSITE FONT

RADIO SELECTIVE CALLING RECEIVER WITH DISPLAY FUNCTION AND A PICTURE INFORMATION DISPLAYING METHOD

BACKGROUND OF THE INVENTION

1. Field of the Invention

This invention relates to a radio selective calling receiver with a display function which can display letter characters and picture information (also called icon) on a display section.

2. Description of the Prior Art

A conventional radio selective calling receiver with a display function of the type mentioned can principally display, on a display section for which an LCD or a like device is employed, received message information or like information for which letter characters are used, and can further display a condition of the receiver and like information for which picture information is used. One of such radio selective calling receivers with a display function is disclosed, for example, in Japanese Patent Laid-Open Application No. Showa 64-19837 which has a sound absent mode and a sound present mode as calling modes thereof and displays, together with received information, an identification mark for the identification between received information when the sound absent mode is set and received information when the sound present mode is set. Another radio selective calling receiver with a display function is disclosed in Japanese Patent Laid-Open Application No. Heisei 3-6134 which includes a plurality of receivers each having a display element for displaying call data and displays, on the display element of each receiver, call data such as a call number and a destination number stored in the receiver.

A legend of picture information (icons) is shown in FIG. 2. Icon a is a picture of a battery on which a slanting line is overwritten, and represents that the battery voltage has dropped. Icon b is a picture of a loudspeaker and represents that notification of a call by sound is set. Icon c is a picture of three horizontal wave-like curved lines and represents that notification of a call by a vibrator is set. The last icon d is a picture of an antenna on which a slanting line is overwritten, and represents that the receiver is outside a receiving area from a base station of a pager system and cannot sufficiently receive radio waves from the base station. On the radio selective calling receiver with a call function just described, the picture information of icons a to d is displayed collectively at a particular location, for example, at a lower location, of the display screen or else displayed between rows of letter characters of a message or the like. By such display, a notification for maintenance is conveyed to a person carrying the receiver.

With the radio selective calling receiver with a display function described above, however, since the display screen of the display section requires, in addition to a display area for letter characters, a display area for picture information, it has the following problems.

If picture information is represented by a single letter character, then the picture information is small and cannot be discerned readily. Consequently, there is a problem that even important picture information is very likely overlooked by the person carrying the receiver. This problem is particularly significant where picture information is displayed between rows of letters of a message or the like because it is difficult to distinguish the picture information and the rows of letters from each other.

A possible solution to the problem described above may seem to display picture information with a comparatively large size. However, in order to display picture information with a comparatively large size, it is necessary either to increase the size of the display screen or to decrease the display area for rows of letters. This makes another problem that it degrades the miniaturization and the convenience in handling, which are important factors of a radio selective calling receiver of the type mentioned.

SUMMARY OF THE INVENTION

It is an object of the present invention to provide a radio selective calling receiver with a display function by which, solving the problems described above, picture information can be displayed in a manner in which it can be discerned readily without increasing the size of the display screen of a display section or without decreasing the size of the display area for letter characters of a message or the like. It is another object of the present invention to provide a picture information displaying method by which picture information can be displayed in a manner in which it can be discerned readily.

In order to attain the object described above, there is provided a radio selective calling receiver with a display function which can display letter characters including received message information on a liquid crystal display section, wherein the display section displays the letter characters in a first color and can display predetermined picture information in a second color different from the first color on the background of the screen on which the letter characters are displayed. The letter characters are formed from a font of a plurality of dots and the picture image information is formed from a plurality of partial picture image fonts, each of the partial picture image font is further formed from a plurality of dots, and each of the plurality of picture image fonts and the respective font of any of the letter characters are superposed with each other at a dot, and the thus superposed dot is displayed in the first color.

The radio selective calling receiver with a display function may be constructed such that the picture information is displayed in a blinking condition.

Or, the radio selective calling receiver with a display function may be constructed such that the letter characters and the picture information are each formed from a font of a plurality of dots, and where the font of the picture information and the font of any of the letter characters are superposed with each other at a dot, the thus superposed dot is displayed in the first color.

In order to attain the second object described above, according to the present invention, there is provided a picture information displaying method which is performed on a radio selective calling receiver which can display letter characters including received message information on a liquid crystal display section, wherein the letter characters are displayed in a first color on the display section, and predetermined picture information is displayed in a second color different from the first color on the background of the screen on which the letter characters are displayed. The letter characters are formed from a font of a plurality of dots and the picture image information is formed from a plurality of partial picture image fonts, each of the partial picture image font is further formed from a plurality of dots, and each of the plurality of picture image fonts and the respective font of any of the letter characters are superposed with each other at a dot, and the thus superposed dot is displayed in the first color.

This picture information displaying method may be constructed such that the picture information is displayed in a blinking condition.

Or, the picture information displaying method may be constructed such that the letter characters and the picture information are each formed from a font of a plurality of dots, and where the font of the picture information and the font of any of the letter characters are superposed with each other at a dot, the thus superposed dot is displayed in the first color.

According to the present invention as described above, since letter characters and picture information are displayed in different colors, the character train and the picture information can be distinguished from each other. Besides, since the picture information is displayed on the background of the screen on which the letter characters are displayed, the picture information can be displayed with a large size over a wide area.

Consequently, by applying the present invention, it is possible to make picture information be discerned readily without increasing the size of the display screen or without decreasing the display area for letter characters.

Further, since the picture information is displayed in a blinking condition, the distinction between the character train and the picture information is further facilitated.

The above and other objects, features, and advantages of the present invention will become apparent from the following description referring to the accompanying drawings which illustrate an example of a preferred embodiment of the present invention.

BRIEF DESCRIPTION OF THE DRAWINGS

In the accompanying drawings:

FIG. 2 is a diagrammatic view showing a legend of icons;

FIG. 4(*b*) is a diagrammatic view showing a font of information (part of icon X) superposed with letter character B; and FIG. 4(*c*) is a diagrammatic view showing a composite font of the fonts of FIGS. 4(*a*) and 4(*b*).

DESCRIPTION OF THE PREFERRED EMBODIMENT

An embodiment of the present invention is described below.

Figure 1:
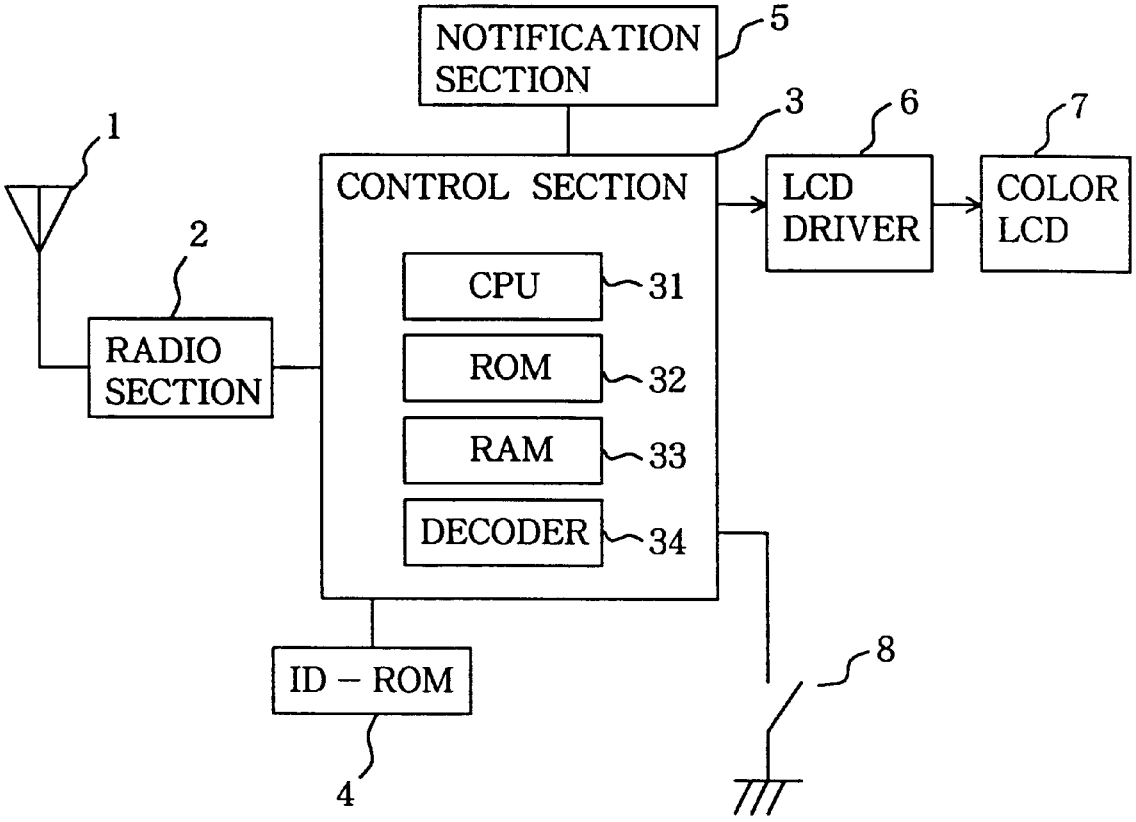
FIG. 1 is a block diagram of an embodiment of a radio selective calling receiver with a display function of the present invention.

FIG. 1 is a block diagram of an embodiment of a radio selective calling receiver with a display function of the present invention.

Antenna 1 receives a radio signal transmitted from a base station of a pager system. The radio signal thus received is in a condition modulated with data such as a selective calling number, and the data sometimes includes a message signal or a like signal following the selective calling number.

Radio section 2 demodulates the radio signal received by antenna 1. The data of a selective calling number, a message signal and so forth demodulated by radio section 2 is transmitted to control section 3.

Control section 3 is formed from decoder 31, CPU 32, ROM 33 and RAM 34. Decoder 31 compares a selective calling number of the radio selective calling receiver itself stored in advance in ID-ROM 4 with the selective calling number demodulated by radio section 2, and outputs coincidence information to CPU 32 when the two selective calling numbers coincide with each other. Upon reception of the coincidence information, CPU 32 causes notification section 5 such as a loudspeaker or a vibrator to perform notification by sound or vibrations. In this instance, if data includes a message signal, then CPU 32 activates LCD driver 6 to drive color LCD 7 (liquid crystal display) to display a message corresponding to the message signal and stores the message signal temporarily into RAM 34. The message signal stored in RAM 34 is read out to, color LCD 7 by a manual operation of switch 8 which is a function switch.

With the present radio selective calling receiver with a display function, the message information is displayed in a row or rows of letter characters such as "kana" characters, alphabetical letters or numerals on color LCD 7.

Further, with the present receiver, in order to allow the call notification function, the maintenance function and so forth mentioned above to function effectively, a calling time or a present time is displayed in a row of characters of a first color, for example, blue, in addition to the message on color LCD 7. Further, picture information having such significance as illustrated in FIG. 2 is displayed in a second color, for example, red, which is different from the first color, on the background of the screen on which the letter characters are displayed. For the picture information, marks similar to icon a which is a low voltage mark illustrated in FIG. 2, icon b and c which are notification setting marks, icon d which is an outside area mark and so forth can be used.

Figure 3:
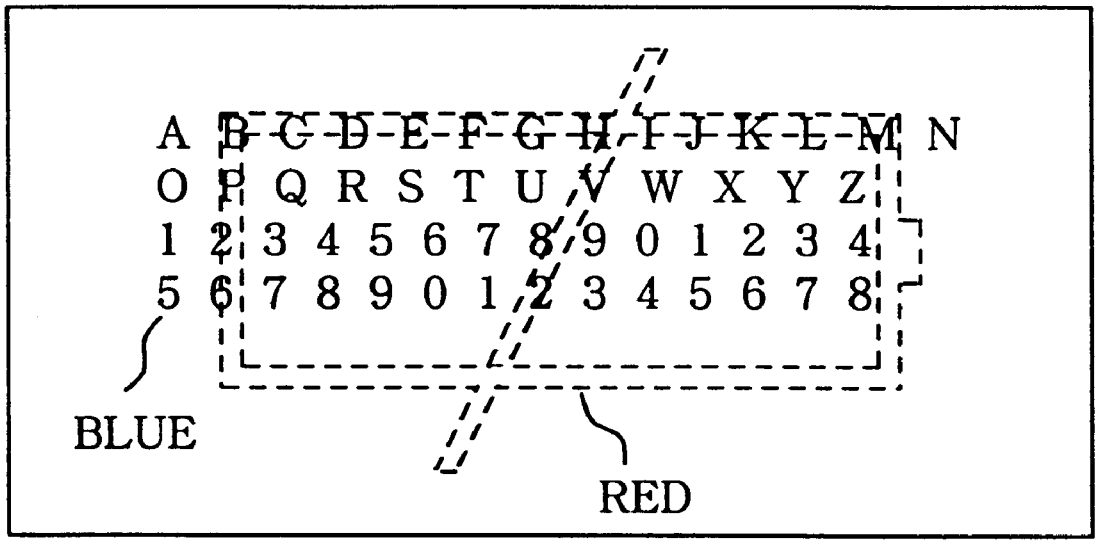
FIG. 3 is a diagrammatic view showing an example of a display on the display screen of color LCD 7.

FIG. 3 is a diagrammatic view showing an example of a display on the display screen of color LCD 7 employed in the present embodiment.

However, a train of characters of a received message of ABCD . . . 123 . . . 678 is displayed in blue on color LCD 7. Further, the radio selective calling receiver with a display function suffers from a drop of the voltage of a battery (not shown), and CPU 32 receives battery voltage drop information from a battery voltage detector (not shown) and causes color LCD 7 to display picture information (hereinafter referred to as icon X) similar to icon a stored in advance in ROM 33. This icon X is displayed in red different from the display color for the letter characters on the background of the train of letter characters in the full area of the display screen of color LCD 7 so that it may be observed very readily by the person carrying the receiver.

Figure 4:
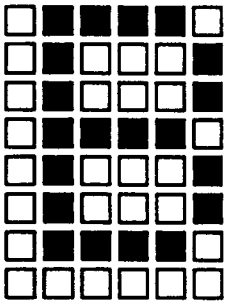
FIG. 4(*a*) is a diagrammatic view showing a font of letter character B in a received message illustrated in FIG. 3.
Figure 4:
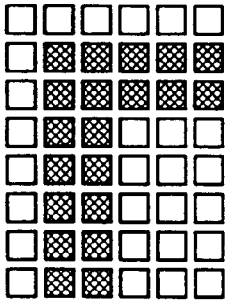
Figure 4:
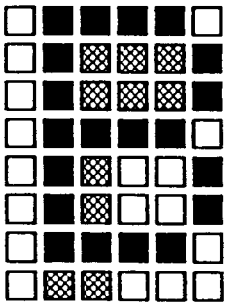

In order to illustrate the principle of operation of the present embodiment, FIG. 4(*a*) shows a font of letter character B in the received message illustrated in FIG. 3, FIG. 4(*b*) shows a font of information (part of icon X) to be superposed with letter character B, and FIG. 4(*c*) shows a composite font of the fonts shown in FIGS. 4(*a*) and 4(*b*).

On color LCD 7 in the present embodiment, one letter character is represented by a font for 8×6 dots. Those font are stored in advance in ROM 33.

In order to display a message and color information (for example, icon x) on color LCD 7, CPU 32 reads out fonts of letter characters and picture information to be displayed from ROM 33, and sends the thus read out fonts, color selection data and position data which represents at which positions the fonts are to be displayed on color LCD 7 to LCD driver 6. LCD driver 6 drives color LCD 7 based on the fonts, the color selection data and the position data thus sent out. Consequently, a message and the color information are displayed on color LCD 7.

Since icon x has a higher effect where it is displayed in a comparatively large size as seen in FIG. 3, icon x here is a font divided into 12 parts in the horizontal direction and into 9 parts in the vertical direction with the font size of 8×6. The individual parts of the divided font are stored into ROM 33 similarly to the fonts of letter characters.

The partial font of icon x superposed with letter character B (blue) shown in FIG. 4(*a*) is an inverted L-shaped font (red) as shown in FIG. 4(*b*). CPU 32 performs calculation for displaying the partial font of the picture information of FIG. 4(*b*) in a superposed condition with the background of the letter character font of FIG. 4(*a*) like such a composite font as shown in FIG. 4(*c*). In particular, CPU 32 applies a dot of a letter character font and a dot of a picture information to each dot of a font of a letter character. In this instance, CPU 32 performs calculation so that color data at a dot at which the letter character font and the picture information are superposed with each other may be the same as data of the color (blue) for the letter characters so that the train of characters may be displayed comparatively clearer.

It is to be noted that blinking of the display of the picture information on the display screen of color LCD 7 will further facilitate the identification between the train of characters and the picture information. The blinking of the picture information can be realized by intermittently performing the composition calculation of a picture information font with a letter character font described above after each several seconds.

What is claimed is:

1. A radio selective calling receiver, comprising:

a memory, said memory storing predetermined picture information;

a liquid crystal display, said liquid crystal display having a plurality of dots, each of said plurality of dots being operable in at least two different colors; and a CPU for controlling the operation of said liquid crystal display, said CPU controlling each of said plurality of dots such that:

said dot is operated in a first color when said dot represents only a part of a received message;

said dot is operated in a second color when said dot represents only a part of said predetermined picture information; and display of said received message takes precedence over said predetermined picture information such that said dot is operated in said first color when said dot represents both said part of said received message and a superposed part of said predetermined picture information.

2. A radio selective calling receiver with a display function as claimed in claim 1, wherein said predetermined picture information is displayed in a blinking condition.

3. A display method performed on a radio selective calling receiver, said radio selecting calling receiver comprising a liquid crystal display, said liquid crystal display having a plurality of dots, the method comprising the steps of:

storing predetermined picture information in a memory;

operating each of said plurality of dots in one of at least two different colors;

controlling the operation of each of said plurality of dots such that:

said dot is operated in a first color when said dot represents only a part of a received message;

said dot is operated in a second color when said dot represents only a part of said predetermined picture information; and display of said received message takes precedence over said predetermined picture information such that said dot is operated in said first color when said dot represents both said part of said received message and a superposed part of said predetermined picture information.

4. A picture information displaying method as claimed in claim 3, wherein said predetermined picture information is displayed in a blinking condition.

5. The radio selective calling receiver as claimed in claim 1, wherein said predetermined picture information is comprised of a plurality of partial picture image fonts.

6. The radio selective calling receiver as claimed in claim 1, wherein said predetermined picture information includes at least one of:

a battery voltage drop icon;

a setting of calling by sound icon;

a setting of calling by vibration calling; and an outside receiving area icon.

7. The display method as claimed in claim 3, wherein said predetermined picture information is comprised of a plurality of partial picture image fonts.

8. The display method as claimed in claim 3, wherein said predetermined picture information includes at least one of:

a battery voltage drop icon;

a setting of calling by sound icon;

a setting of calling by vibration calling; and an outside receiving area icon.

* * * * *